US008079103B2

(12) United States Patent
Sevadjian et al.

(10) Patent No.: US 8,079,103 B2
(45) Date of Patent: Dec. 20, 2011

(54) ACTIVATION MEANS FOR POSITION ADJUSTMENT OF A THERAPEUTIC TABLE

(75) Inventors: Mardig Sevadjian, Oakville (CA); Wally Couto, Oakville (CA)

(73) Assignee: Cardon Rehabilitation & Medical Equipment, Ltd. (CA)

( * ) Notice: Subject to any disclaimer, the term of this patent is extended or adjusted under 35 U.S.C. 154(b) by 0 days.

(21) Appl. No.: 12/702,808

(22) Filed: Feb. 9, 2010

(65) Prior Publication Data

US 2010/0205741 A1 Aug. 19, 2010

Related U.S. Application Data

(60) Provisional application No. 61/151,024, filed on Feb. 9, 2009.

(51) Int. Cl.
*A47B 7/00* (2006.01)

(52) U.S. Cl. ..... 5/611; 5/600; 5/616; 5/510

(58) Field of Classification Search ..... 5/611, 600, 5/616, 424, 425, 93.1, 510
See application file for complete search history.

(56) References Cited

U.S. PATENT DOCUMENTS 3,742,527 A * 7/1973 Johnston et al. ..... 5/611
4,534,077 A * 8/1985 Martin ..... 5/616
4,907,845 A * 3/1990 Wood ..... 5/600

* cited by examiner

*Primary Examiner* — Robert G Santos
*Assistant Examiner* — Brittany Wilson
(74) *Attorney, Agent, or Firm* — The H.T. Than Law Group

(57) ABSTRACT

The present invention is a therapeutic table with an improved position adjustment mechanism and to a method for adapting a therapeutic table to include an improved mechanism for position adjustment of a table. In an embodiment, the improved position adjustment mechanism is a ribbon switch on the top surface of a frame forming the base of the table and a ribbon switch on the bottom surface of a frame forming the base of the table, which ribbon switch when pressure is applied activates the movement of the table up and down, respectively.

4 Claims, 2 Drawing Sheets

ACTIVATION MEANS FOR POSITION ADJUSTMENT OF A THERAPEUTIC TABLE

CROSS-REFERENCE TO RELATED APPLICATION

The present application claims priority to commonly-owned U.S. provisional application 61/151,024 filed on Feb. 9, 2009 under 35 U.S.C. 119(e) and which is incorporated by reference herein its entirety.

FIELD OF THE INVENTION

The invention relates generally to a therapeutic table with an improved activation means for a therapeutic table with one or more position adjustment mechanisms and to a method for adapting a therapeutic table to include an improved activation means for position adjustment.

BACKGROUND OF THE INVENTION

Therapeutic tables and beds are typically adjustable to move the patient or client to the desired configuration for the particular treatment and the desired height to enable therapists of different sizes to work effectively and comfortably. There are many different modes of adjusting position on these tables and beds including those controlled by a hand-held unit, by a hand activated panel, or by foot to enable the hands to remain free. When foot power is used, typically a foot pedal or buttons on a foot pad at the base of a therapeutic table is pushed by foot to activate an actuator which raises or lowers or otherwise changes the position of the table.

U.S. Pat. No. 4,724,554 describes the use of foot pedals for a patient treatment table having a first raised horizontal position for treatment and a second position closer to the vertical for mounting and dismounting. Foot pedals activate the electric motor to move the table.

There are also many patents which describe the use of safety systems for preventing patients from being crushed in the table structure when moving the table (as described in U.S. Pat. Nos. 4,724,554 and 4,534,077) or for alerting caregivers that a patient is leaving the bed or is close to the edge and about to fall out (as described in U.S. Pat. Nos. 3,961,201; 4,539,560; and 5,075,523).

In U.S. Pat. No. 4,724,554, a safety system is included in which a switch mat is positioned on the floor surface and as the footboard or end portion of the table structure approaches the switch mat, if a person or object is pinched in between, pressure is exerted on the switch mat and this either de-energizes the electric motor and/or deactivates the control valves and stops further downward travel of the table structure.

U.S. Pat. No. 4,534,077 describes a hospital bed warning system which includes an elongate detection device such as an air-tight, flexible tube or a ribbon switch mounted to one of the frames so that a person wedged between the frames will contact it prior to incurring serious injury. The detection device is connected to a switch which deactivates the bed raising/lowering motor.

In U.S. Pat. No. 4,539,560 the bed departure detection device includes tape switch detectors in fixed positions in the seat and thigh sections of the mattress supporting structure of an articulated hospital bed.

Ribbon or tape switches are also used in U.S. Pat. No. 6,452,123 on a foot pedal for controlling a hand piece for the control of irrigation, aspiration in connection with phacoemulsification of natural lenses.

What is needed is an improved means to adjust the position of a therapeutic table that is unobtrusive, accessible from any position around the table and very easy and comfortable to use.

Although ribbon switches are used on therapeutic tables or beds to indicate if a patient is being caught in the table or if a patient is leaving the bed; and have been used on a foot pedal to activate a hand held medical device; and although foot pedals and foot activated buttons have been used to adjust the height of a therapeutic table or bed; a ribbon switch has never been contemplated for use to activate the movement of a therapeutic table or bed into a desired position.

SUMMARY OF THE INVENTION

The present invention relates to a therapeutic table with an improved activation means for a therapeutic table with one or more position adjustment mechanisms and to a method for adapting a therapeutic table to include an improved activation means for position adjustment.

The invention is a therapeutic table with one or more position adjustment mechanisms and an activation means comprising one or more ribbon switches, whereby the activation of said particular position adjustment mechanism is achieved by applying pressure on said corresponding ribbon switches.

More particularly, an embodiment of the present invention is a therapeutic table comprising a position adjustment mechanism which moves the table up and down, and upward activating ribbon switches and downward activating switches, whereby applying pressure on the upward activating switches moves the table up and applying pressure on said downward activating switches moves the table down.

This therapeutic table further comprises a base with an accessible top surface and accessible bottom surface, whereby the upward activating ribbon switches are positioned on the top surface of the base and the downward activating ribbon switches are positioned on the bottom surface of the base.

A further aspect of the present invention is a method of adapting a therapeutic table comprising a position adjustment mechanism and a control means for activating said mechanism for position adjustment, in which said control means is replaced by an activation means comprising one or more ribbon switches, whereby the activation of said mechanism for position adjustment is achieved by applying pressure on said ribbon switches.

More particularly, the present invention is also a method of adapting a therapeutic table comprising a base with an accessible top surface and accessible bottom surface, a mechanism for position adjustment up and down, and a control means for activating said mechanism, in which said control means is replaced by an activation means comprising one or more ribbon switches positioned on the top surface of the base and one or more ribbon switches positioned on the bottom surface of the base, whereby the activation of said mechanism for position adjustment up is achieved by applying pressure on said ribbon switches on the top surface and the activation of said mechanism for position adjustment down is achieved by applying pressure on said ribbon switches on the bottom surface.

DESCRIPTION OF THE DRAWINGS

In the drawings which illustrate by way of example only a preferred embodiment of the invention.

DETAILED DESCRIPTION OF THE DRAWINGS

The present invention relates to a "therapeutic table" or "bed" and these terms are used interchangeably herein, and reference to the term "therapeutic table" in this description encompasses any adjustable physiotherapeutic, medical or paramedical tables, beds, benches or platforms, including chiropractic and osteopathic tables. These tables are adjustable in position to facilitate the patient to get on and off of the table, to position the patient properly for the particular treatment or their comfort and to enable the therapist to work effectively given their stature.

The present invention is a therapeutic table with a position adjustment activation means. The present invention is also a method for adapting a therapeutic table to include this activation means for position adjustment of a table.

Figure 1:
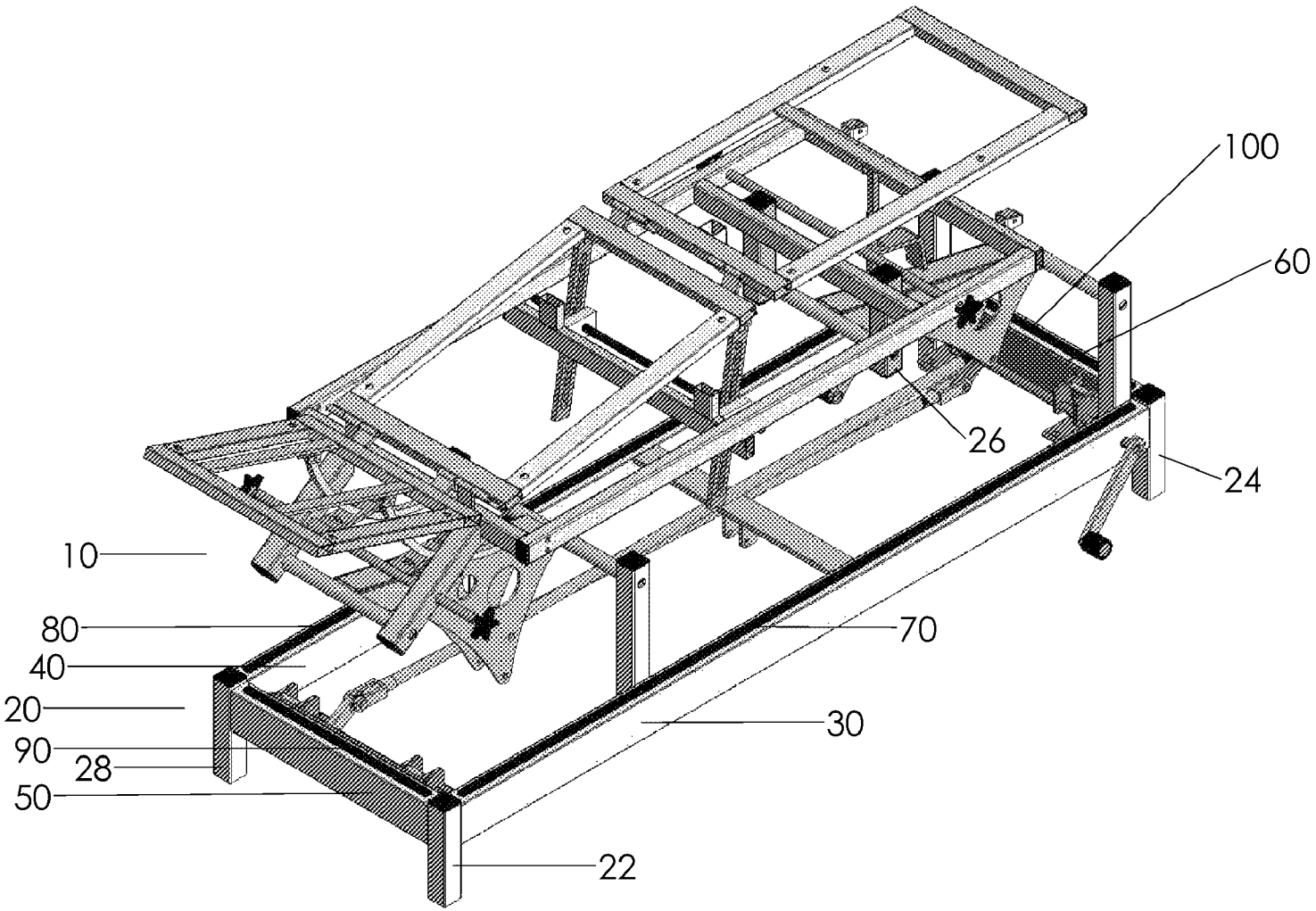
FIG. 1 is a perspective top view of a therapeutic table with a position adjustment mechanism.

In one embodiment, a therapeutic table with a position adjustment activation means is shown as set out in FIG. 1. Various designs of therapeutic tables may be used which have a suitable structure that can accommodate ribbon switches, as will be described.

For the purposes of demonstrating the invention, the therapeutic table 10 is shown in FIG. 1 without mattress or other additions which are normally included when in finished form. The table 10 has a stable base 20 which is positioned around the lower perimeter of table 10. In this particular embodiment four legs 22, 24, 26, 28 support a substantially rectangular frame formed of a first lengthwise slat 30 between legs 22, 24 parallel to a second lengthwise slat 40 between legs 26, 28, and joined at the ends by first crosswise slat 50 and second crosswise slat 60, respectively.

Typically therapeutic tables have an electric motor or some power source combined with a mechanical structure capable of moving, and an actuator for directing the change in position of the table and this is referred to as the "position adjustment mechanism". The position adjustment mechanism is typically activated by a control means, such as a hand held device or foot pedal or control panel. In this invention, the ribbon switch activation means is used in place of the typical control means to switch on the position adjustment mechanism, and in the example of this simple embodiment, to move the table up or down.

A ribbon switch, also known as a tape switch, is a tape (or strip) whose electrical resistance is pressure sensitive, typically changing its conductivity from off state to on state when a predetermined pressure (force) is applied thereto, i.e., acting as an electrical switch. Ribbon switch may be purchased from the TapeSwitch Corporation in Farmingdale, N.Y., United States and from London Mat Industries of London, Ontario, Canada in almost any length needed and as such can be attached to objects of various length and configuration, provided that the wires at the end of the ribbon switch can be connected as desired.

In FIG. 1, lengths of ribbon switch 70, 80, 90 and 100 are adhered to and run along the top surface of slat 30, slat 40, slat 50 and slat 60, respectively. The ribbon switch may be adhered with any glue or adhesive that adheres the ribbon switch to the surface of the frame. Stretches of ribbon switch are shown running along the entire surface of the slats 30, 40, 50, 60 respectively but can be positioned as desired by the user since the ribbon switch is available in various lengths. The wires of the ribbon switches 70, 80, 90, 100 are connected in sequence and the last one is connected to an actuator of the position adjustment mechanism.

Figure 2:
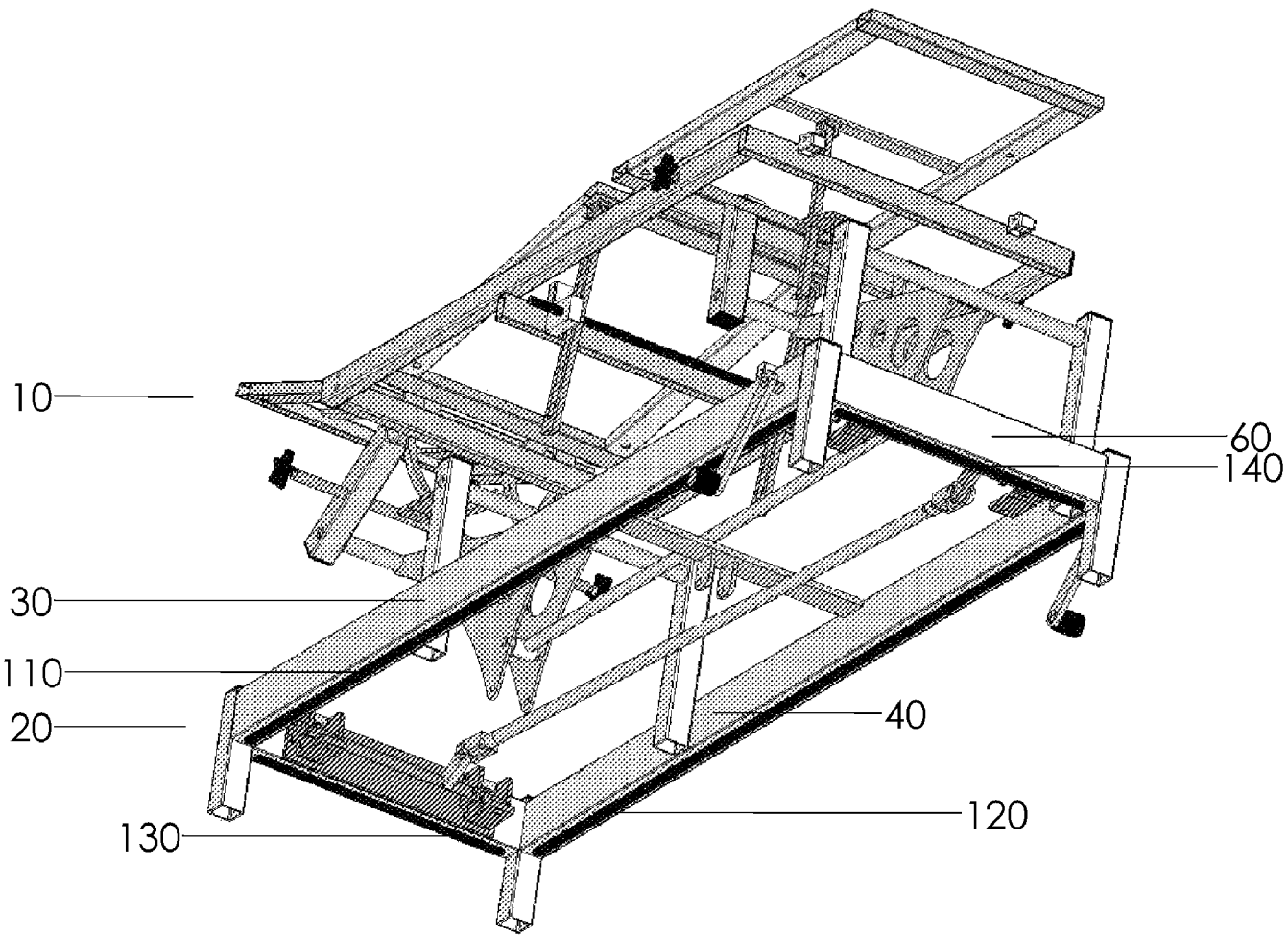
FIG. 2 is a perspective bottom view of a therapeutic table with a position adjustment mechanism.

Likewise, in FIG. 2, lengths of ribbon switch 110, 120, 130, 140 are adhered to and run along the bottom surface of slat 30, slat 40, slat 50 and slat 60, respectively. The ribbon switches are shown running along the entire surface of the slats 30, 40, 50, 60, respectively but can be positioned as desired by the user. Again the wires of the ribbon switches 110, 120, 130, 140 are connected in sequence and the last one is connected to an actuator of the position adjustment mechanism.

The base of the therapeutic table for the purposes of this embodiment of the invention may be of any configuration that provides a surface that extends around the perimeter of the table and is capable of having a ribbon switch attached to it in a manner that makes it accessible to the user and capable of connecting the ribbon switch wires to the actuator of the position adjustment mechanism.

Slight pressure of a therapist's foot applied to the top ribbon switch 70, 80, 90, 100 or the bottom ribbon switch 110, 120 130, 140 shown in FIGS. 1 and 2, results in movement of the table up and down, respectively, as long as the pressure is applied to the ribbon switch. The ribbon switches 70, 80, 90, 100 are referred to as upward activating ribbon switches and the ribbon switches 110, 120, 130, 140 are referred to as downward activating ribbon switches.

In order to move the table up in a comfortable manner for the therapist, the therapist lightly steps on the ribbon switch 70, 80, 90, 100 with any portion of the foot. In order to move the table down in a comfortable manner for the therapist, the therapist applies gentle pressure to the downward activating ribbon switches 110, 120, 130, 140 by placing the toe portion of the foot under one of these switches and gently tilting the foot up to apply pressure to the respective switch while the heel remains on the ground.

This invention also relates to a method of adapting a therapeutic table that is already position adjustable by replacing the control means with ribbon switch along the base of the therapeutic table or other desired location on the table. Wires extending from each end of each ribbon switch are connected to an actuator that is either already a part of the therapeutic table or to be attached to the therapeutic table.

While ribbon switches are typically capable of withstanding millions of application of pressure, it is contemplated that at some point the ribbon switch may need to be replaced with new ribbon switch.

It is understood that this invention is a therapeutic table with an improved position adjustment activation means through the use of ribbon switches placed on or about the table. As such this invention includes positioning of the ribbon switches in any location on or about a therapeutic table and variations in the location and number of ribbon switches are contemplated. For example, one continuous ribbon switch around the upper perimeter of the base of a therapeutic table and one continuous ribbon switch around the bottom perimeter of the base is contemplated.

As well it is contemplated that the ribbon switches in the embodiment of the invention in FIGS. 1 and 2 could be switched, that is, upward and downward activating ribbon switches could be reversed without changing the nature of this invention.

For a table that is capable of height adjustment as well as adjusting the parts of the table such as the head, midsection and end of the table, multiple ribbon switches can be used with their own actuator to move that particular part of the table or adjust the height of the table.

Various embodiments of the present invention having been thus described in detail by way of example, it will be apparent to those skilled in the art that variations and modifications may be made without departing from the invention. The invention includes all such variations and modifications as fall within the scope of the appended claims.

We claim:

1. A therapeutic table with a position adjustment mechanism to adjust a position of the therapeutic table and at least one ribbon switch wherein a pressure applied on said at least one ribbon switch activates said position adjustment mechanism to adjust the position of the therapeutic table, wherein the therapeutic table further comprises a base with an accessible top surface and accessible bottom surface, wherein said at least one ribbon switch comprises a first activating ribbon switch is positioned substantially around the top surface of the base and/or a second activating ribbon switch is positioned substantially around the bottom surface of the base, such that said at least one ribbon switch can be activated from substantially around the table.

2. The therapeutic table of claim 1, wherein said position adjustment mechanism moves the therapeutic table up and down, and wherein the first activating ribbon switch is an upward activating switch and the second activating ribbon switch is a downward activating switch, whereby applying pressure on said upward activating switch moves the therapeutic table up and applying pressure on said downward activating switch moves the therapeutic table down.

3. A method for updating a therapeutic table having a position adjustment mechanism to vary a position of the therapeutic table and a control for activating the position adjustment mechanism comprising the step of (a) replacing the control with at least one ribbon switch; and (b) positioning the at least one ribbon switch on a base of the therapeutic table, wherein said at least one ribbon switch comprises a first activating ribbon switch is positioned substantially around a top surface of the base and/or a second activating ribbon switch is positioned substantially around a bottom surface of the base, such that said at least one ribbon switch can be activated from substantially around the table; and (c) wherein applying a pressure on said position adjustment mechanism to vary the position of the therapeutic table.

4. The method of claim 3, wherein applying pressure on said position adjustment mechanism moves the therapeutic table upward or downward.

* * * * *